US005357876A

United States Patent [19]

Kniefel et al.

[11] Patent Number: 5,357,876

[45] Date of Patent: Oct. 25, 1994

[54] PORTABLE HINGED RISER

[75] Inventors: John H. Kniefel; Leslie R. Abraham, both of Owatonna; Glenn G. Kanengieter, deceased, late of Owatonna, by Dorette E. Kanengieter, heiress; Frank C. Krumholz, Owatonna, all of Minn.

[73] Assignee: Wenger Corporation, Owatonna, Minn.

[21] Appl. No.: 790,214

[22] Filed: Nov. 7, 1991

[51] Int. Cl.[5] ..... A47B 57/00

[52] U.S. Cl. ..... 108/92; 108/64

[58] Field of Search ..... 108/92, 64, 11, 13, 108/93, 53.5, 901, 63; 52/7, 8, 182, 183

[56] References Cited

U.S. PATENT DOCUMENTS

| | | | |
|---|---|---|---|
| 310,226 | 1/1885 | Rice et al. . | |
| 1,514,055 | 11/1924 | Lawson . | |
| 2,841,831 | 7/1958 | Mackintosh . | |
| 2,981,365 | 4/1961 | Olsen . | |
| 3,035,671 | 5/1962 | Sicherman . | |
| 3,564,790 | 2/1971 | Rehfeld | 108/92 X |
| 4,025,137 | 5/1977 | Wyler | 108/93 X |
| 4,580,776 | 4/1986 | Burkinshaw . | |
| 4,740,042 | 4/1980 | Stich et al. | 108/901 X |
| 4,951,576 | 8/1990 | Cobos et al. | 108/901 X |

FOREIGN PATENT DOCUMENTS

| | | | |
|---|---|---|---|
| 164655 | 5/1949 | Australia | 52/7 |

*Primary Examiner*—Jose V. Chen

*Attorney, Agent, or Firm*—Patterson & Keough

[57] ABSTRACT

In accordance with the present disclosure, a portable riser unit for supporting persons or objects above the ground, a floor, a stage or the like is provided. The riser broadly comprises a base, generally rectangular step members, and hinge joints for pivotally, hingedly connecting the step members to the base. The base has an integrally formed, convoluted internal or interior support and baffle wall structure and may be filled with an appropriate low density, high volume material. Each step member also may be of this construction; however, the step members may or may not have an internal support wall. The step members are operably coupled to the base by double axis hinges including hinge blocks received in complementary hinge wells in the base and step members. The hinges are self-leveling to present a substantially smooth, level riser support surface in every possible configuration. The riser may be molded of a plastic material and includes integral hand grips to facilitate moving step members or the entire riser. By manipulating the step members, the riser may be reshaped into a variety of operable configurations. The invention also encompasses connector keys for connecting two or more risers into a riser assembly.

21 Claims, 6 Drawing Sheets

Fig. 4
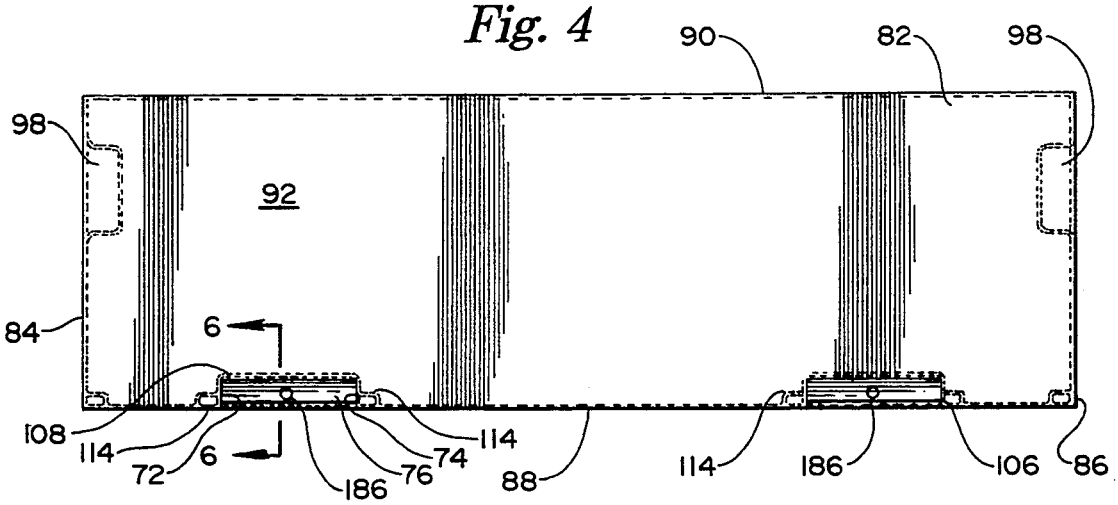
Fig. 5
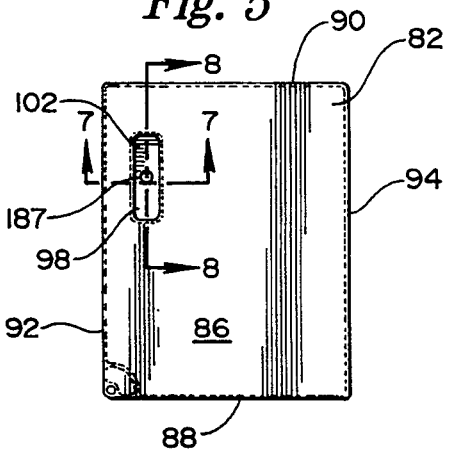
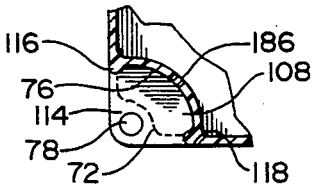
Fig. 6
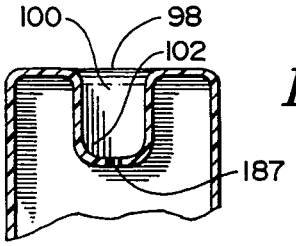
Fig. 7
Fig. 8
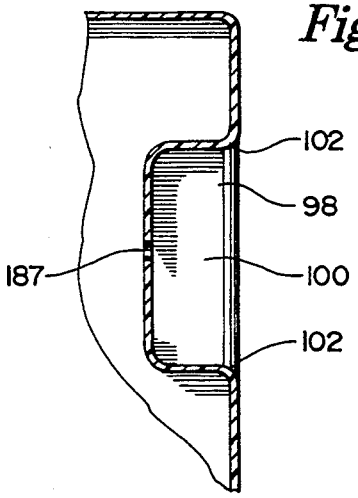

PORTABLE HINGED RISER

TECHNICAL FIELD

The present invention relates to portable supports for supporting persons or objects above the ground, a floor, a stage or the like. More particularly, the present invention relates to a portable riser that can be moved and re-shaped quickly, quietly and conveniently into a variety of configurations.

BACKGROUND OF THE INVENTION

Collapsible or portable staging is known in the prior art. U.S. Pat. No. 4,580,766 (Burkinshaw) discloses a collapsible staging or raised platform for presenting various types of entertainment. The staging is formed by staging modules having first and second end frames at either end and side frames between the end frames, and may include collapsible stairs that have different widths, as well as different heights. The side frames each comprise hingedly connected sub-frames whereby the entire module may fold inwardly in "concertina fashion". Though connected, the platforms and flames are distinct elements and a platform to frame and frame to frame locking or engaging means is required.

Somewhat similarly, U.S. Pat. No. 2,841,831 (Mackintosh) discloses a folding stage wherein floor slabs or panels are collapsibly supported by leg frames and guide braces. The panels are hinged so they may be collapsed "zig-zag fashion".

Although well suited for their intended purpose, the stages disclosed in the Burkinshaw and Mackintosh patents require a frame mechanism or structure that is discrete from the platform or panels that form the platform. Additionally, the manipulation of the stages disclosed in Burkinshaw and Mackintosh will create substantial noise.

U.S. Pat. No. 310,226 (Rice et al.) is directed to providing foldable or folding steps. The Rice et al. patent discloses folding steps consisting of a box or platform "A" provided with a series of preferably triangular steps "B" hinged or pivoted therein by a vertical bolt or rod "a". The steps may be pivoted relative to each other as at "b", and are adapted to be drawn out of or entirely folded within the box. One end of each step is provided with a casing to hide the space beneath the steps. There are several problems the Rice et al. steps do not solve. Because of the space beneath the steps, moving and folding the steps will create noise. The triangular step shape is not as safe for supporting persons as a rectangular shape because of the small horizontal support surface at the apex area of each triangular step. There is no disclosure of a way to join and secure more than one set of the folding steps to each other.

U.S. Pat. No. 3,035,671 (Sicherman) is directed to providing portable folding steps for use in an exercise test. The steps consist of two folding steps nine inches wide and nine inches high hingedly mounted on opposite sides of a central step nine inches wide and eighteen inches from the floor. The two steps are supported by pivotally collapsible braces and are movable from a storage position wherein they are folded over the top of the central step to an unfolded, extended position. A tubular framework is required, and only two arrangements or configurations are possible: a storage configuration and a use configuration. In use, the steps can be unfolded only to a shape wherein they have equal top upper surface areas. The hinges connecting the steps are exposed and have raised areas, therefore presenting an uneven surface. Tubular leg braces and spring clips are required and, if the clips or braces are not fully locked or deployed, the steps could be unstable.

Step-like display stands, such as that disclosed in U.S. Pat. No. 1,514,055 (Lawson), are also known. The Lawson stand includes treads, risers and upright side support plates, all connected by rule joint hinges. The stand may be collapsed by folding the upright sides, treads and risers into close parallel relation. There is no disclosure of a way to join and secure together more than one set of the step-like display units, and they will be noisy during deployment and collapse.

It is clear that with current collapsible staging and portable risers, safety, cost efficient fabrication, convenient, quiet rapid setup and movement, and the capacity for achieving multiple configurations are not provided to an optimum degree. Accordingly, there is a need for a strong, efficient, easily moved and re-shaped, safe and quiet portable riser for supporting persons or objects above the ground, a stage, a floor or the like.

SUMMARY OF THE INVENTION

In accordance with the present invention, a portable riser unit for supporting persons or objects above the ground, a floor, a stage or the like is provided. The riser broadly comprises a base, generally rectangular step members, and hinge means for pivotally, hingedly connecting the step members to the base. By manipulating the step members, the riser may be re-shaped into a variety of operable configurations, including a storage shape. The base has a generally hollow single-piece body formed by a substantially continuous relatively thin wall or skin and an integral convoluted interior or internal support and baffle wall structure, and may be substantially filled with an appropriate low density, high volume material. Each step member also may be of this construction; however, the step members may or may not have an internal support wall. Each step member is operably coupled to the base by at least one double or twin axis hinge, including a hinge block received in complementary hinge wells in the base and step members. The hinges are self-leveling to present a substantially smooth, level riser support surface in every possible configuration. The riser may be rotationally molded of a plastic material and includes integral hand grips to facilitate moving the individual step members or the riser as a whole. Two or more adjacent risers may be used to form a riser assembly, and the invention encompasses a connector key for connecting adjacent risers.

An object of the present invention is to provide an articulated portable riser unit strong enough to support people safely, yet light enough to move quickly and easily.

Another object of the present invention is to provide a portable riser adapted for quick and easy re-shaping into a variety of configurations, whereby the riser facilitates supporting persons or objects above the ground, a floor, a stage or the like in a variety of heights and arrangements. Advantageously, the configurations include at least a platform configuration, wherein the riser presents a single, generally flat, raised uppermost support surface, a seated riser configuration wherein two parallel support surfaces having unequal surface areas are provided, and a standing riser configuration presenting a stair-like shape with three support surfaces, each in a different plane and having a substantially equal area.

An advantage of the present invention is that it provides a portable, reconfigurable riser unit or assembly that is suitably durable and rigid, yet does not require a discrete support frame mechanism. Further, no special tools, nor an extended period of time, are required to assemble, reshape or move the riser. The portable riser of the present invention may be used for many purposes in institutions, including elementary and secondary schools, day care facilities, and churches. It is particularly useful in the performing arts wherein rapid, quiet redeployment or rearrangement of scenery or persons is required during the course of a performance.

Still another object of the present invention is to provide a portable riser to support persons or objects above the ground, a floor, a stage or the like, wherein the riser presents substantially smooth, uniformly finished and level visible horizontal and vertical surfaces.

Yet another object of the present invention is to provide a riser that is quiet to use, move and reshape. The riser has at least one integral, convoluted support and baffle interior wall structure and the remainder of the substantially hollow base and step members may or may not be filled with an expanded material. Whether filled or not, another advantage of the riser of the present invention is that it tends to minimize noise, both the hollow "booming" noise generated as people step on prior art risers and the noise caused by moving or folding prior art risers, yet it remains light enough to be moved easily.

Other advantages of the riser of the present invention are that it provides for efficient use of labor by minimizing the number of persons required to move and reconfigure it. Additionally, the base, and each step member, are molded as a single integral piece, thus eliminating the need for separate folding support or frame structures and other components.

Other objects and advantages of the present invention will become more fully apparent and understood with reference to the following specification and to the appended drawings and claims.

BRIEF DESCRIPTION OF THE DRAWINGS

FIG. 4 is a top plan view of the larger high step member of the riser of the present invention.

FIG. 5 is a side elevational view of the high step member.

FIG. 6 is a fragmentary sectional detail taken along line 6—6 in FIG. 4.

FIG. 7 is a fragmentary sectional detail taken along line 7—7 in FIG. 5.

FIG. 8 is a fragmentary sectional detail taken along line 8—8 in FIG. 5.

DETAILED DESCRIPTION OF THE PREFERRED EMBODIMENT

Figure 1:
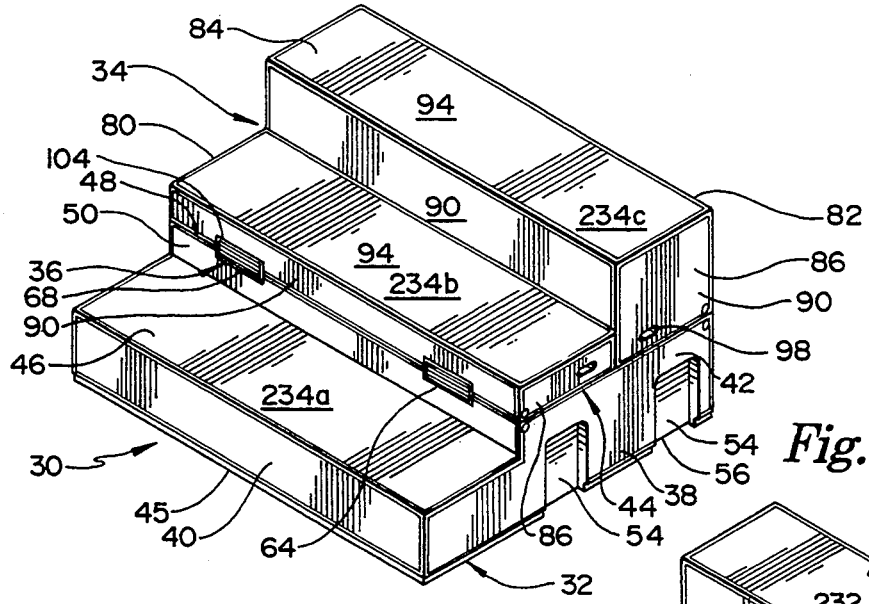
FIG. 1 is a perspective view of the portable hinged riser unit of the present invention, arranged in a three step shape.

The portable hinged riser unit 30 in accordance with the present invention broadly includes a base 32, at least two step members 34 and a plurality of connecting hinge joints 36. In FIGS. 1-3 and 13 the riser 30 is depicted resting generally horizontally on the ground, a floor, a stage or the like.

Figure 9:
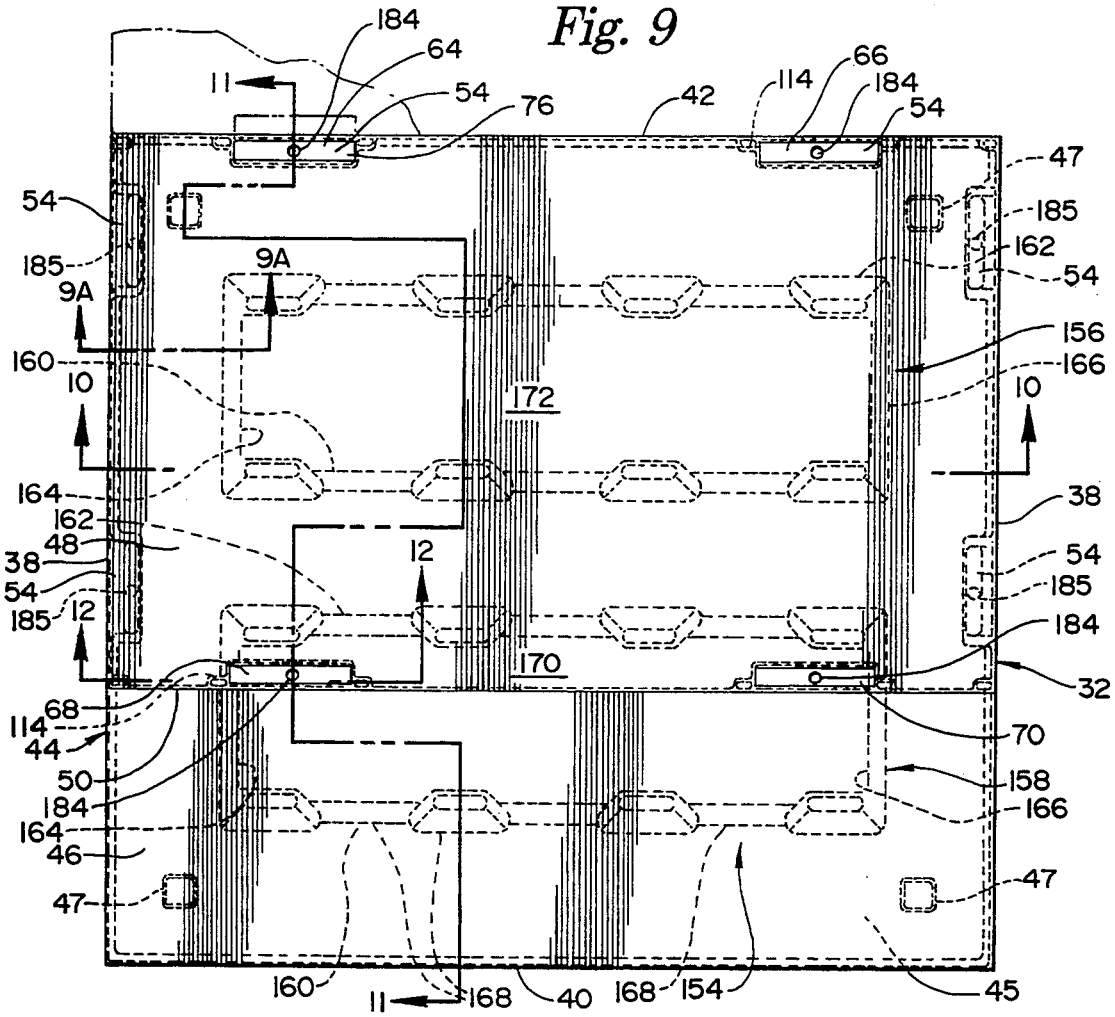
FIG. 9 is a top plan view of the base member of the portable riser assembly of the present invention, and includes a fragmentary view of a second riser shown in phantom.
Figure 9A:
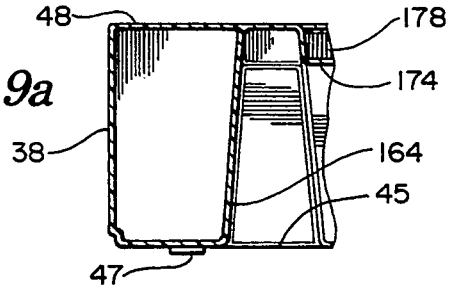
FIG. 9A is a fragmentary section detail taken along line 9A—9A in FIG. 9.

Referring to FIGS. 1 and 9, the base 32 has a substantially closed, polygonal, plane figure body with two opposed generally parallel side walls 38, a front wall 40, a rear wall 42 parallel to the front wall 40, a generally flat top support surface 44, and a bottom 45. A plurality of ground, stage or floor contacting feet 47 are connected to the bottom 45. The feet 47 may be threadably coupled to the base 32, but other connective methods may be employed as well. The top surface 44 includes a lower level 46 and an upper level 48 in different, but parallel planes. A front facing midwall 50 extends generally perpendicularly between and connects the lower and upper levels 46, 48. All of the aforementioned walls, surfaces and levels are in substantially parallel or perpendicular relationship with respect to each other and those joined together are continuously and rigidly joined along straight intersecting edges.

Figure 10:
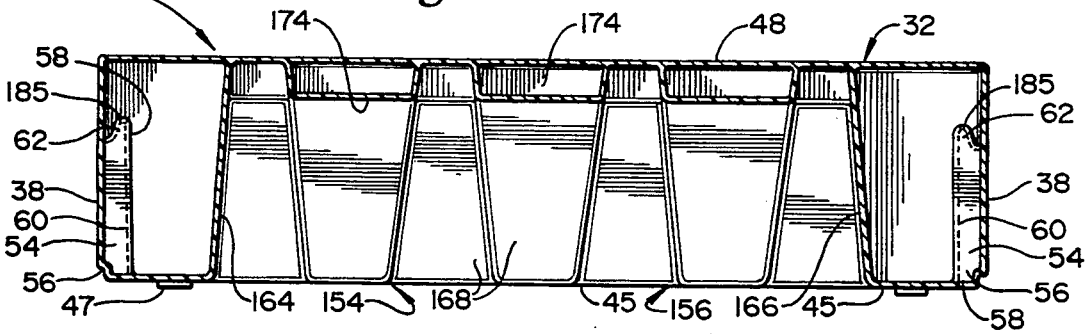
FIG. 10 is a sectional elevation taken along line 10—10 in FIG. 9.
Figure 11:
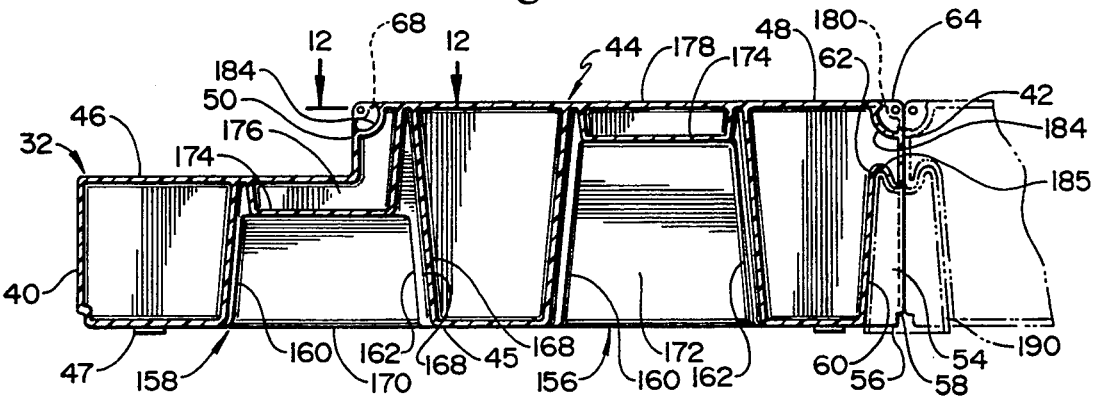
FIG. 11 is a sectional elevation taken along line 11—11 in FIG. 9.

At least two spaced, integrally formed lift handles 54 are formed in the lower regions of each side wall 38 and in the rear wall 42 of the base 32. Referring to FIGS. 10 and 11, each hand receiving lift handle 54 includes an opening 56 with rounded edges 58. An angled continuous inside wall 60 tapers generally outwardly, at approximately five degrees, from bottom to top in the direction of the surface of the upper level 48 of the base 32. A finger receiving relieved area 62 is provided at the uppermost portion of each lift handle 54.

Figure 12:
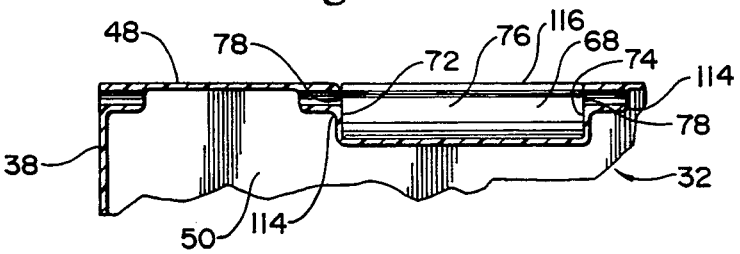
FIG. 12 is a fragmentary detailed section taken along line 12—12 in FIG. 9.

Referring to FIG. 9, a first pair of hinge wells 64, 66 is adjacent the edge formed by the intersection of the outside surface of the upper level 48 and the rear wall 42 of the base. Each hinge well 64, 66 is above, and substantially in-line with, one of the lift handles 54. A second pair of hinge wells 68, 70 is adjacent the edge formed by the intersection of the midwall 50 and the outside surface of the upper level 48 of the base 32. Referring to FIG. 12, each hinge well 64, 66, 68, 70 in the base 32 has opposed, parallel hinge well end walls 72, 74 and a smoothly curved or arcuate hinge well wall 76. A hinge pin bore 78 is formed in each hinge well end wall 72, 74.

Referring to FIGS. 1 and 4, the step members 34 include at least a first, low step member 80 and a second, high step member 82 (depicted in FIG. 4). The two step members 80, 82 are polygonal, generally rectangular, having end walls 84, 86, front and rear side walls 88, 90, respectively, and interchangeable, reversible top and bottom walls 92, 94, respectively. All references to front and rear and top and bottom, particularly as to the walls of the step members 80, 82, are made with reference to the position and orientation of the members 80, 82 depicted in FIG. 3. All of the walls of the step members 80, 82 are arranged in generally parallel or perpendicular relationship with respect to one another, and the junction of the walls are generally straight, continuous edges. The step members 80, 82 are substantially similar, but the high step member 82 is relatively larger than the low step 80. Both step members 80, 82 have an equal length between their end walls 84, 86, also equal to the length of the base 32 between the side walls 38. Additionally, the width of the step members 80, 82 between their front and rear walls 88, 90 is substantially equal. The volume of the high step member 82 is larger than the volume of the low step member 80 because the height or thickness of the high step 82 between the top and bottom walls 92, 94 is greater than that of the low step 80.

At least one handhold 98 is set in each end wall 84, 86 of the step members 34. FIGS. 5, 7 and 8 depict one of the handholds 98, particularly the handhold 98 in the end wall 86 of the high step 82. Each of the plurality of handholds 98 is substantially identical, being a shallow, handhold well 100 integrally formed in the end walls 84, 86 of the step members 80, 82 and having rounded edges 102.

Referring back to FIG. 3, a first pair of spaced hinge wells 104, 106 is adjacent the edge formed by the intersection of the rear side wall 90 and the top wall 92 of the low step member 80. The low step member hinge wells 104, 106 compliment the hinge wells 68, 70 of the base 32. Similarly, a second pair of spaced hinge wells 108, 110 is adjacent the edge formed by the intersection of the front side wall 88 and the top wall 92 of the high step 82. The second pair of hinge wells 108, 110 compliment the hinge wells 64, 66 at the edge of the base 32 formed by the intersection of the upper surface of the upper level 48 and the rear wall 42.

The connecting hinge joints 36 include the base hinge wells 64, 66, 68, 70, the complimentary step member hinge wells 104, 106, 108, 110, and a plurality of hinge blocks 112. FIGS. 4, 6, and 12 depict additional details of the plurality of substantially identical hinge wells, using hinge well 108 of the high step member 82 as representative of all the hinge wells. Each hinge well includes parallel, opposed hinge well end walls 72, 74 and a curved, generally rear hinge well wall 76. In-line hinge pin bores 78 are adjacent each end wall 72, 74. More specifically, each bore 78 is located through a hinge pin mount 114 integrally associated with each end wall 72, 74. A raised bead 116, 118 is immediately adjacent the outermost region of the curved hinge well wall 76. The parallel raised beads 116, 118 extend from end wall to end wall 72, 74.

Figure 15:
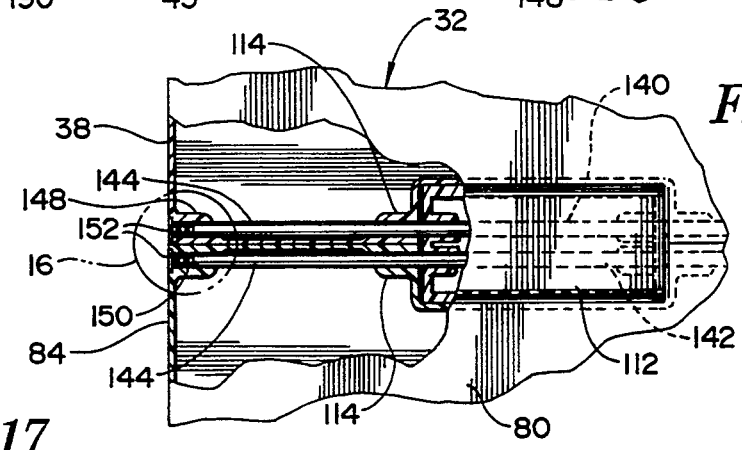
FIG. 15 is a fragmentary top plan detailed view depicting two adjacent hingedly connected members of the hinged riser of the present invention, with portions cut away.
Figure 17:
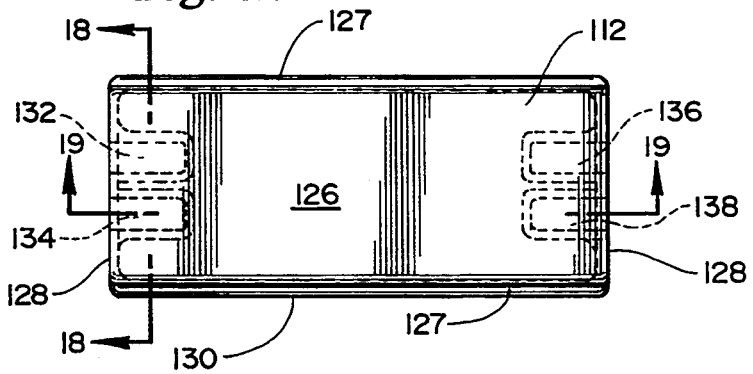
FIG. 17 is a top plan view of a hinge block for use with the riser of the present invention.
Figure 18:
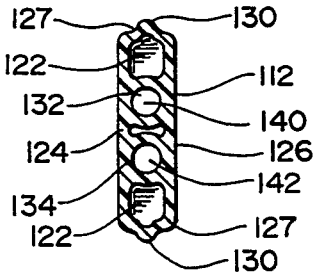
FIG. 18 is a sectional elevation taken along line 18—18 in FIG. 17.
Figure 19:
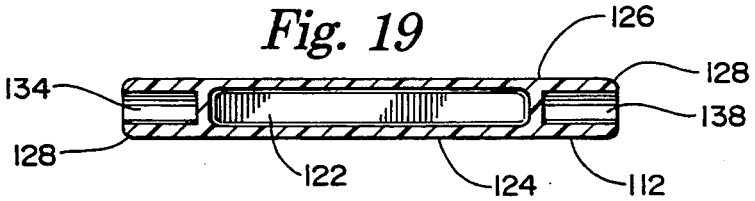
FIG. 19 is a sectional elevation taken along line 19—19 in FIG. 17.

All of the hinge wells receive, or partially receive, substantially identical hinge blocks 112, depicted in FIGS. 17, 18 and 19. Each hinge block 112 is a generally rectangular body having a pair of voids 122, a bottom wall 124, a top wall 126, side walls 127, and end walls 128. Each side wall 127 has a linear, longitudinally extending rib stop 130 that runs the length of the wall 127. Each hinge block 112 includes four hinge pin holes 132, 134 and 136, 138, a pair of the holes 132, 134 and 136, 138 being preformed in each end wall 128. As depicted in FIGS. 18 and 15, the hinge pin holes 132, 134, 136, 138 are drilled to form two parallel hinge pin bores 140, 142 for receiving hinge pins 144. The hinge pins 144 are parallel with respect to each other and extend continuously through the hinge pin bores 140, 142 and into hinge pin bore mounts 114 formed in the base 32 and in the step members 80, 82.

Figure 16:
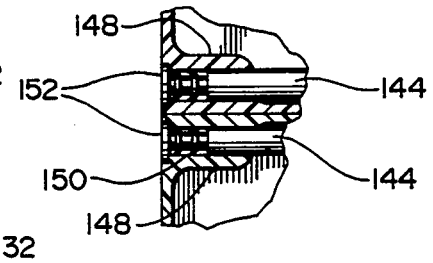
FIG. 16 is an enlarged fragmentary detail of the area encircled at 16 in FIG. 15.

Referring to FIGS. 15 and 16, intended to be representative of all the hinge joints 36, one of the hinge blocks 112 is depicted connecting the low step member 80 to the base 32. The end wall 84 of the lower step 80 and the end wall 38 of the base 32 include integral hinge pin receiving shoulders 148 and apertures 150. The apertures 150 may be formed during the molding process, drilled, punched or formed in other suitable ways, and are in line with the hinge pin mounting bores 140, 142 through the hinge block 112. A button head plug 152 is received in each aperture 150 after the pins 144 are inserted into the block 112.

Referring to FIGS. 9, 9A, 10 and 11, the base 32 of the riser 30 includes a convoluted, integrally formed interior support and baffle wall structure 154 comprising a pair of wavy, ribbon-like continuous web structures 156, 158. The interior webs 156, 158 extend continuously at a slight angle from vertical between the bottom wall 45 and top surface 44 of the base 32 to define a generally "FIG. 8" shaped, substantially hollow, closed tubular body for the base 32. Each web structure 156, 158 is integrally formed with the walls or skin forming the remainder of the base 32, and includes two opposed parallel longer sides 160, 162 parallel to the front and rear sides 40, 42, respectively, of the base 32, and two opposed parallel shorter sides 164, 166 parallel to the side walls 38 of the base 32. Each interior web 156, 158 is formed to include a plurality of alternating trapezoidal buttress support panels 168. Adjacent panels 168 of the longer sides 160, 162 lie in parallel planes, as do the panels 168 of the shorter sides 164, 166.

The two open central areas 170, 172 of the "FIG. 8" shaped base 32 are formed by the webs 156, 158. The areas 170, 172 have an open lower region adjacent to the bottom 45 of the base 32 and are closed by a flat subfloor wall 174 closely adjacent and parallel to the underside of the upper surface 44 of the base 32. The subfloor wall 174 is connected to the webs 156, 158 to form two closed cell subfloor voids 176, 178. The void 176 closest to the front wall 40 of the base 32 partially underlies the lower level 46 of the base 32 and is generally "L-shaped". The volume of the voids 176, 178 is substantially less than the volume of the tubular base 32.

Referring to FIGS. 9, 10 and 11, base fill holes 184 are formed in the rear walls 76 of the base hinge wells 64, 66, 68, 70. Base vent holes 185 are formed in the lift handles 54. Referring to FIGS. 4, 5, and 6, step fill holes 186 are formed in the step member hinge wells 104, 106, 108, 110 and step member vent holes 187 are formed any selected handhold 98.

Figure 13:
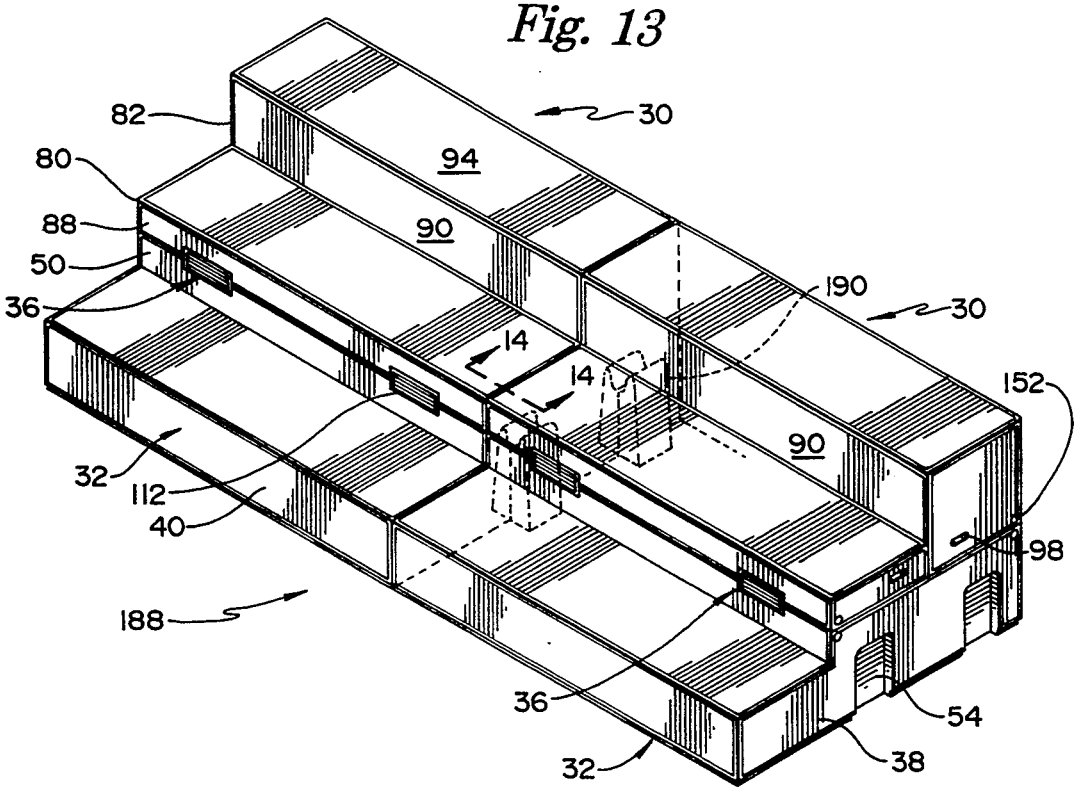
FIG. 13 is a perspective view of two of the riser units of the present invention joined to form a two-unit riser assembly.
Figure 14:
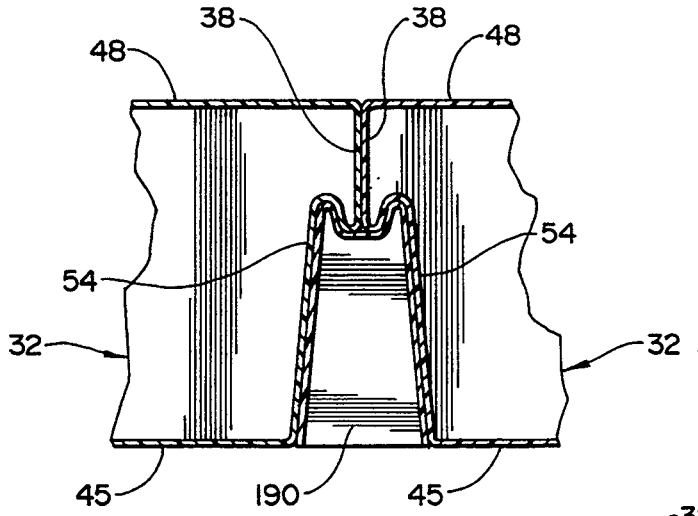
FIG. 14 is a fragmentary sectional elevation taken along line 14—14 in FIG. 13.
Figure 20:
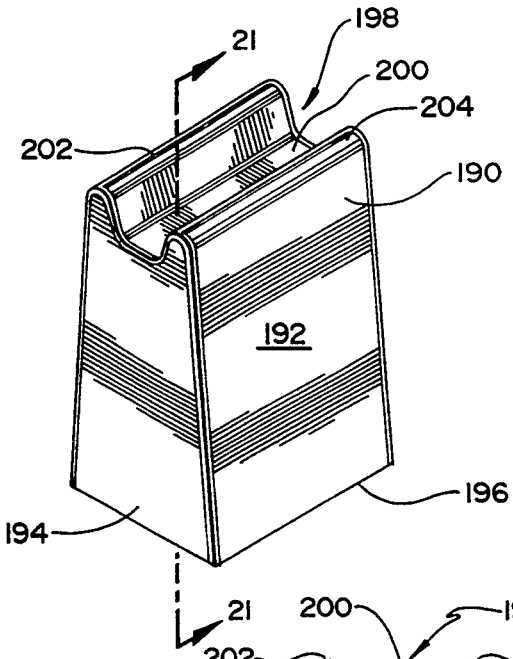
FIG. 20 is a perspective view depicting a key connector for use in connecting together the risers of the present invention to form a riser assembly.
Figure 21:
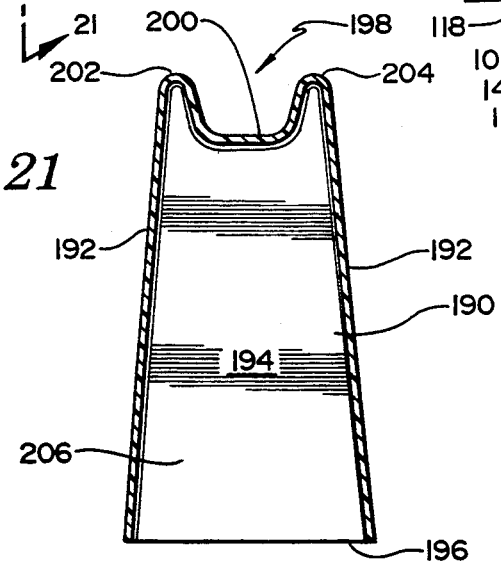
FIG. 21 is a sectional elevation taken along line 21—21 in FIG. 20.

The hinged riser units 30 of the present invention may be connected to one another to form a riser assembly 188, depicted in FIGS. 13 and 14. A connector key 190 for connecting individual risers 30 is depicted in FIGS. 20 and 21. Each key 190 has inclined side walls 192 that match the draft angle of the walls 60 defining the lift handles 54 formed in the side walls 38 and rear wall 42 of the base 32. Key end walls 194 closely compliment the end walls of the lift handles 54. Opposite the key base 196, each key 190 has a crown area 198 comprising an inwardly curved cusp 200 between a pair of parallel rounded ridges 202, 204. The key connectors 190 have a hollow interior 206.

Figure 22:
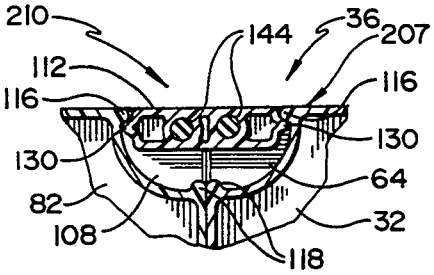
FIG. 22 is a fragmentary sectional detail depicting the hinged connection between two members of the riser of the present invention.
Figure 23:
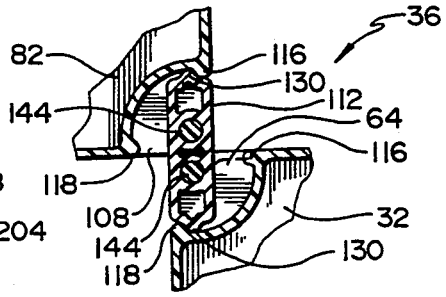
FIG. 23 is a view similar to that in FIG. 22, but depicting the hinged connection when the members of the riser are in another position.

One of the hinge joints 36 connecting the step members 80, 82 to the base 32 is depicted in FIGS. 22 and 23. The joint 36 depicted is between the high step member 82 and the base 32, but is typical of all the connecting hinge joints 36 of the present invention. The joint 36 includes the base hinge well 64, step hinge well 108, and a hinge block 112. Two parallel hinge pins 144, each providing an axis for rotation and movement of the hinge block 112 within the hinge wells 64, 108, extend through the hinge block 112. Referring specifically to FIG. 22, the upper surface 207 of the hinge block 112 is substantially level with the surfaces of the base 32 and the step 82, whereby the overall support surface 210 is substantially smooth and level.

If the high step 82 is raised or lowered slightly relative to the base 32, the hinge block 112 will float about the two axes provided by the hinge pins 144 until one or the other of the ribs 130 comes in contact with one of the beads 116, 118 of the hinge wells 64, 108. Thus, without requiring the raised portions typical of piano or rule joint hinge structures, the hinge joint 36 compensates for unevenness of the surface upon which the riser is resting without damaging the joint 36. Additionally, even if the base 32 and steps 80, 82 are misaligned with respect to one another, the hinge 36, and specifically the hinge block 112, always presents a substantially smooth and continuous visible surface.

FIG. 23 depicts the hinge joint 36 of FIG. 22 in another position and illustrates the control function of the ribs 130 and hinge well beads 116, 118. Because the hinge block 112 is free to move within the limits provided by the beads 116, 118 and ribs 130, the step 82 is easy to move relative to the base 32, any misalignment between the base 32 and the step 82 will be compensated for, and a smooth visible surface is provided.

Figure 19A:
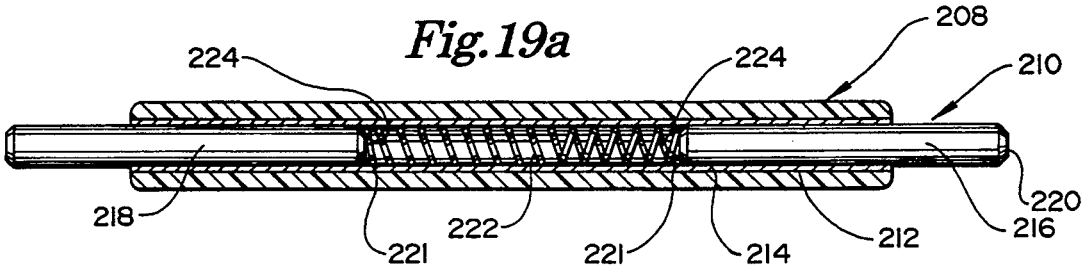
FIG. 19A is a sectional elevation depicting another embodiment of the hinge block for use with the riser of the present invention.

Referring to FIG. 19A, the hinge joint 36 of the present invention may include another embodiment or form of hinge blocks 208 and split hinge pins 210. This hinge block 208 is substantially similar in size and exterior features as the hinge block 112 described above (and depicted in FIGS. 17, 18 and 19), and includes similar internal voids and pin bores. The hinge block 208 includes two parallel pre-formed hinge-pin bores 212, each with a lining sleeve 214. The sleeve 214 may be formed of suitable material including various metals or plastics. The pin 210 includes first and second pivot rods 216, 218, each having chamfered ends 220, 221. A compression spring 222 is between the rods 216, 218. Although not depicted, the ends 224 of the spring 222 may be partially received in or connected to the rod ends 221.

The riser base 32 and step members 80, 82 are rotationally or centrifugally molded from a suitable plastic material. After formation, the substantially hollow base 32 and step members 80, 82 are filled with an expanded material using the fill holes 184 and 186, which then may be closed. The hinge blocks 112, specifically the bores 140, 142, are drilled and placed in the aligned, complimentary base and step hinge wells (base wells 64, 66, 68, 70 and step wells 104, 106, 108, 110) and the hinge pins 144 are inserted through the drilled apertures 150 in the shoulders 148, the drilled bores 140, 142 in hinge block 112 and the drilled bores 78 in mounts 114. The plug 152 is counter sunk in the aperture 150 and the riser 30 is ready for use.

If the second form of the hinge block 208 and pins 210 is used, the shoulders 148 and apertures 150 in the base 32 and step members 80, 82 may be eliminated. The bores 78 are not drilled through the mounts 114, but have a closed bottom end in the mounts 114. To use the hinge block 208 and pins 210, the rods 216, 218 and a spring 222 are axially aligned end-to-end with the spring 222 in the middle and are placed in the bores 212 in the hinge block 208, as depicted in FIG. 19A. The rods 216, 218 are urged toward each other in the bores 212 against the bias of the spring 222. The block 208 is placed in aligned base and hinge step wells and the rods 216, 218 are released and snap into the bores 78.

Figure 2:
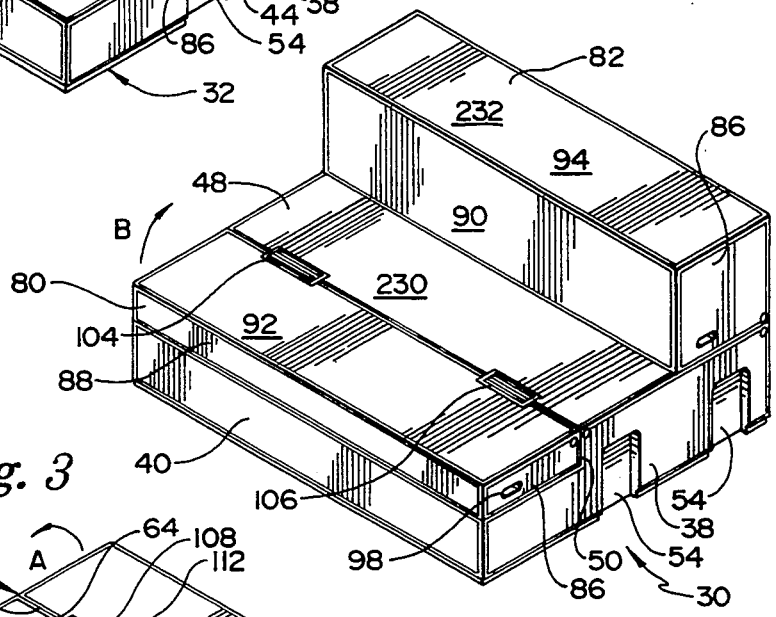
FIG. 2 is a perspective view of the present invention in a two step, seated riser configuration.
Figure 3:
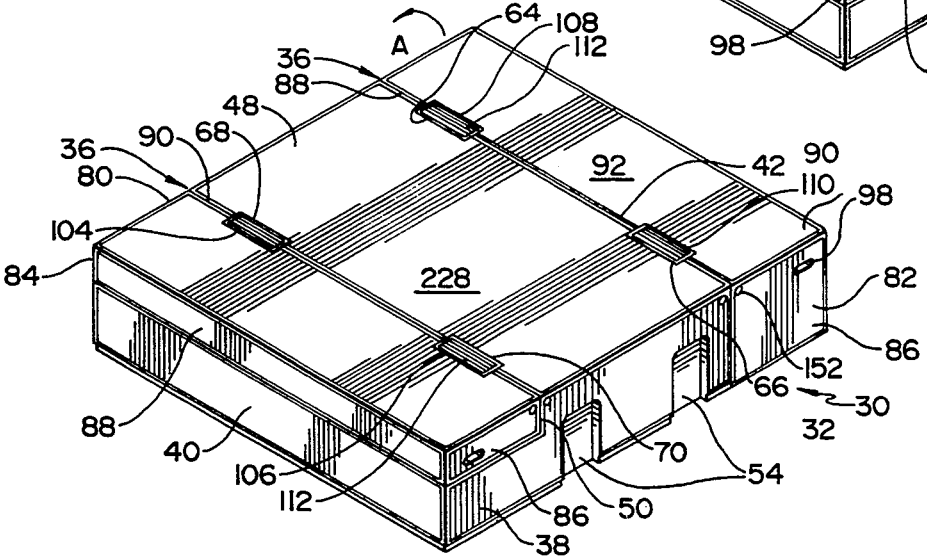
FIG. 3 is a perspective view of the riser of the present invention in a stage or platform configuration.

Referring to FIGS. 1-3 and 13, the hinged riser 30, and riser assemblies 188, of the present invention may be shaped and reshaped into various alternative shapes. A completely deployed, open stage or platform configuration is depicted in FIG. 3. The stage configuration presents a smooth, flat, substantially continuous, horizontal top supporting surface 228.

A seated riser configuration is depicted in FIG. 2. To achieve the seated riser configuration, the high step 82 has been pivotally lifted in the direction of arrow A in FIG. 3 until the top surface 92 of the step 82 is closely adjacent and parallel to or in contact with the surface of the upper level 48 of the base 32. The handholds 98 in either the end wall 86 of the high step 82 may be used conveniently to lift and rotate the high step 82 into the position depicted in FIG. 2. A lower foot surface 230 and an elevated seat surface 232 are formed. The seat surface 232 has a smaller surface area than the foot surface 230.

FIG. 1 depicts the riser 30 arranged in a standing riser configuration. The high step 82 remains in the position depicted in FIG. 2. The low step 80 has been pivotally raised or moved, using the handholds 98, in the direction of arrow B (FIG. 2) until the outer surface of the top wall 92 is closely parallel to or touching the outside surface of the upper level 48 of the base 32. Three uppermost step support surfaces 234*a*, 234*b*, and 234*c*, each with a substantially equal surface area, are thus formed. The vertical rise between the lowest step surface 234*a* and the surface beneath the base bottom 45, and between each successive step surface 234*b* and 234*c*is equal.

For moving the entire riser 30 and for storing it, the riser 30 may be lifted by the lift handles 54 and carried to the place of storage where it may be placed or stacked in any convenient configuration.

A number of variations of the present invention can be made. For example, although a riser 30 having a polygonal plane figure shape is described, other suitable shapes, such as circular or oval risers are possible. The described base 32 has two interior webs 156, 158, but any member of the webs may be used. Additionally, although the webs 156, 158 form generally polygonal (specifically rectangular) open central areas 170, 172, the areas may be oval or circular. The risers 30, including the base 32 and the step members 80, 82, and riser assemblies 188, could be provided in various sizes to accommodate various institutional, staging or presentation needs. The riser 30, and the component members thereof, are formed advantageously by rotational molding, but other conventional fabrication and assembly methods might be used as well. The low density filler material used to fill the substantially hollow base 32 and the hollow step members 80, 82 may be an expanded s tyrene, but other low density materials may be used as well. The locations of the fill and vent holes 184, 186 providing access to the hollow interior of the base 32 and steps 80, 82 may be varied. The hinge blocks 112 (or 208) and pins 144 (or 210) may be formed from any suitable materials, but it would be advantageous to select a material that maintains the light weight and overall uniform appearance of the riser 30. The exterior of the riser 30, and riser assemblies 188, may be coated with appropriate substances to impart desirable characteristics such as a particular color or a non-slip feel. Although foot pads 47 are described, the riser 30 may be equipped with other ground or floor contacting devices including casters or wheels. An appropriate lock mechanism such as hook/eye, friction or snap, interlocking fabric, or pin/aperture arrangements may be used to hold the step members 80, 82 in their various positions relative to the base 32. Such lock mechanisms may be used in conjunction with the hinge joints 36 or may also be used as the functional equivalents of the hinge joints 36 to couple the step members 80, 82 and the base 32.

It should be understood that the steps 80, 82 may be easily separated or disassembled from the riser base 32 by removing the button plugs 152, then pulling the hinge pins 144 (or compressing the alternative pins 210). Thus, the purchaser has the option of how to purchase the riser 30; it may be purchased fully assembled with the steps 80, 82 connected to the base 32, or as separate component pieces. Additionally, bases 32 and step members 80, 82 may be interchanged easily.

Although a description of the preferred embodiment has been presented, it is contemplated that various changes, including those mentioned above, could be made without deviating from the spirit of the present invention. It is therefor desired that the described embodiments be considered in all respects as illustrative, not restrictive, and that reference be made to the appended claims rather than to the foregoing description to indicate the scope of the invention.

What is claimed is:

1. A portable support comprising a plurality of operably coupled, substantially closed hollow bodies, said bodies including a base and at least one step member, said base and at least one step member having thin, substantially continuous walls and being substantially filled with a low density material, said support including a hinge means for operably coupling said base and at least one step member, said hinge means having at least one hinge assembly comprising structure defining a base hinge well in said base;

structure defining a step member hinge well in said at least one step member;

a hinge block shiftably received within said base hinge well and said step member hinge well; and first and second hinge pins operably carried by said hinge block for pivotally coupling said hinge block to said base and step member respectively.

2. The support according to claim 1, wherein said hinge pin means comprises at least one elongated hinge pin received by and extending longitudinally through said hinge block means, said pin comprising two spaced, axially aligned rods having a length less than the length of said hinge pin and a spring means for biasing said rods away from each other, said spring means being in said space between said rods.

3. A riser assembly for supporting persons and objects at selected heights above a support surface, comprising:

a base member having a lower surface supported by said support surface, a front portion, a rear portion, a first upper surface extending along said rear portion oriented at a first height relative to said lower surface, and a second upper surface extending along said front portion and oriented at a second height which is lower than said first height to define a base member upper surface recess;

a first step member operably coupled to said case member rear portion, said first step member shiftable between a first configuration wherein said first step member presents an upper surface generally flush with said base member first upper surface and a second configuration wherein said first step member presents an upper surface oriented generally above said base ember first upper surface at a third height which is higher than said first height; and a second step member selectively receivable within said base member upper surface recess, said second step member shiftable between a first position wherein said second step member is operably received within said base member upper surface recess such that the second step member presents an upper surface generally flush with said base ember first user surface and a second position wherein said second step member is operably carried by said first upper surface such that the second step member presents an upper surface oriented at a fourth height which is higher than said first height but lower than said third height.

4. A riser assembly as claimed in claim 3, including a front facing midwall extending between said first upper surface and said second upper surface, said front facing midwall and sad first upper surface defining a first surface upper front margin, said second step member presenting a second step member coupling margin, said second step member being operably, hingeably coupled to said base member generally along said first surface upper front margin and said second step member coupling margin.

5. A riser assembly as claimed in claim 4, said base member including a rear wall, said first upper surface and said rear wall defining a first surface upper rear margin, said fist step member being operably, hingeably coupled to said base member generally along said first surface upper rear margin and said first step member coupling margin.

6. A riser assembly claimed in claim 5, said first surface upper front margin and said first surface upper rear margin being oriented generally parallel to each other, said first surface presenting a first surface width extending between said first surface upper front margin and said first surface upper rear margin, said first step member and said second step member being positioned in side by said orientation an together extending generally across said first surface width when said first step member is in said second configuration and said second step member is in said second position.

7. A riser assembly as claimed in claim 3, said base member including a rear wall, said first upper surface and said rear wall defining a first surface upper rear margin, said first step member being operably, hingeably coupled to said base member generally along said first surface upper rear margin and said first step member coupling margin.

8. A riser assembly as claimed in claim 3, said base member including opposed side walls, each of said side walls presenting an upper side wall margin and a sidewall height extending from said base member lower surface to said upper side wall margin, each of said side walls further including structure defining at least one recess extending generally upwardly from said lower surface along said side wall, said recesses adapted to receive a connector key for selectively coupling together a pair of riser assemblies in side by side relationship.

9. A riser assembly as claimed in claim 8, said recesses each including an inside wall tapering outwardly from said bottom surface to the upper portion of said recess extending generally upwardly from said lower surface along said side wall, said recesses adapted to receive a connector key for selectively coupling together a pair of said riser assemblies in side by side relationship.

10. A riser assembly as claimed in claim 9, said connector key including a pair of opposed, inclined side walls each tapered at an angle conforming to the taper of said recess inside walls, and a pair of opposed, upper cusps, each cusp adapted to be received within the finger receiving relieved area of one of said recesses, whereby said key can be received in the aligned recesses of a pair of side by side riser assemblies to couple said pair of riser assemblies together.

11. A riser assembly for supporting persons and objects at selected heights above a support surface, comprising:

a base member having a lower surface supported by said support surface, a front portion, a rear portion, a first upper surface extending along said rear portion oriented at a first height relative to said lower surface, and a second upper surface extending along said front portion and oriented at a second height which is lower than said first height to define a base member upper surface recess; and a step member shiftable between a first position wherein said step member is operably received within said base member upper surface recess such that said step member presents an upper surface generally flush with said base member first upper surface and a second position wherein said step member is operably supported by said base member first upper surface to present an upper surface oriented at a third height which is higher than said first height.

12. A riser assembly as claimed in claim 11, including a front facing midwall extending between said first upper surface and said second upper surface, said front facing midwall and said first upper surface defining a first surface upper front margin, said step member presenting a step member coupling margin, said step member being operably, hingeably coupled to said base member generally along said first surface upper front margin and said step member coupling margin.

13. A riser assembly as claimed in claim 12, said base member including opposed side walls, each of said side walls presenting an upper side wall margin and a sidewall height extending from said base member lower surface to said upper side wall margin, each of said side walls further including structure defining at least one recess extending generally upwardly from said lower surface along said side wall, said recesses adapted to receive a connector key for selectively coupling together a pair of said riser assemblies in side by side relationship.

14. A riser assembly as claimed in claim 13, said recesses each including an inside wall tapering outwardly from said bottom surface to the upper portion of said recess, the upper portion of said recess including structure defining an uppermost finger receiving relieved area to present a downwardly facing hand graspable handle.

15. A riser assembly as claimed in claim 14, said connector key including a pair of opposed, inclined side walls each tapered at an angle conforming to the taper of said recess inside walls, and a pair of opposed, upper, cusps, each cusp adapted to be received within the finger receiving relieved area of one of sad recesses, whereby said key can be received in the aligned recesses of a pair of side by side riser assemblies to couple said pair of riser assemblies together.

16. A riser assembly for supporting persons and objects at selected heights above a support surface, comprising:

a base member having a lower surface supported by said support surface, a long portion, a rear portion, and a first upper surface extending along said rear portion oriented at a first height relative to said lower surface; and a first step member operably coupled to said base member rear portion, said first step member shiftable between a first configuration wherein said firs step member presents an upper surface generally flushed with said base member first upper surface and a second configuration wherein said first step member presents an upper surface oriented generally above said base member first upper surface at a second height which is higher than said first height.

17. The invention as claimed in claim 16, said base member including a second upper surface extending along said base member front portion and oriented at a third height which is lower than said first height to define a base member upper surface recess.

18. A riser assembly as claimed in claim 16, said base member including opposed side walls, each of said side walls presenting an upper side wall margin and a sidewall height extending from said base member lower surface to said upper side wall margin, each of said side walls further including structure defining at least one recess extending generally upwardly from said lower surface along said side wall, said recess adapted to receive a connector key for selectively coupling together a pair of said riser assemblies in side by side relationship.

19. A riser assembly as claimed in claim 18, said recesses each including an inside wall tapering outwardly from said bottom surface to the upper portion of said recess, the upper portion of said recess including structure defining an uppermost finger receiving relieved area to present a downwardly facing hand graspable handle.

20. A riser assembly as claimed in claim 19, said connector key including a pair of opposed, inclined side walls each tapered at an angle conforming to the taper of said recess inside walls, and a pair of opposed, upper cusps, each cusp adapted to be received within the finger receiving relieved area of one of said recesses, whereby said key can be received in the aligned recesses of a pair of side by side riser assemblies to couple said pair of riser assemblies together.

21. The invention as claimed in claim 17, including a second step member shiftable between a first position wherein said step member is operably received within said base member upper surface recess such that said step member presents an upper surface generally flush with said base member first upper surface and a second position wherein said step member is operably supported by said base member first upper surface to present an upper surface oriented at a fourth height which is higher than said first height but lower then said second height.

* * * * *

UNITED STATES PATENT AND TRADEMARK OFFICE

CERTIFICATE OF CORRECTION

PATENT NO. : 5,357,876
DATED : October 25, 1994
INVENTOR(S) : John H. Kniefel et al.

It is certified that error appears in the above-indentified patent and that said Letters Patent is hereby corrected as shown below:

Column 1, line 23, delete "flames" and substitute therefor —frames—.

Column 3, line 67, delete "section" and substitute therefor —sectional—.

Column 8, line 66, delete "234cis" and substitute therefor —234c is—.

Column 9, lines 20-21, delete "s tyrene" and substitute therefor —styrene—.

Column 10, line 2, after the word "comprising" add — – —.

Column 10, line 30, delete "case" and substitute therefor —base—.

Column 10, line 37, delete "ember" and substitute therefor —member—.

Column 10, line 45, delete "ember" and substitute therefor —member—.

Column 10, line 46, delete "user" and substitute therefor —upper—.

UNITED STATES PATENT AND TRADEMARK OFFICE

CERTIFICATE OF CORRECTION

PATENT NO. : 5,357,876
DATED : October 25, 1994
INVENTOR(S) : John H. Kniefel et al.

It is certified that error appears in the above-indentified patent and that said Letters Patent is hereby corrected as shown below:

Column 10, line 55, delete "sad" and substitute therefor —said—.

Column 11, line 1, delete "assembly claimed" and substitute therefor —assembly as claimed—.

Column 11, line 8, delete "said" and substitute therefor —side—.

Column 11, line 8, delete "an" and substitute therefor —and—.

Column 11, line 28 delete "of riser" and substitute therefor —of said riser—.

Column 11, lines 33-36, delete "extending generally upwardly from said lower surface along said side wall, said recesses adapted to receive a connector key for selectively coupling together a pair of said riser assemblies in side by side relationship" and substitute therefor —, the upper portion of said recess including structure defining an uppermost finger receiving relieved area to present a downwardly facing hand graspable handle—.

Column 12, line 29, delete the comma after the word "upper".

Column 12, line 39, delete "long" and substitute therefor —front—.

Column 12, line 45, delete "firs" and substitute therefor —first—.

UNITED STATES PATENT AND TRADEMARK OFFICE

CERTIFICATE OF CORRECTION

PATENT NO. : 5,357,876
DATED : October 25, 1994
INVENTOR(S) : John H. Kniefel et al.

It is certified that error appears in the above-indentified patent and that said Letters Patent is hereby corrected as shown below:

Column 12, line 47, delete "flushed" and substitute therefor —flush—.

Column 12, line 64, delete "recess" and substitute therefor —recesses—

Signed and Sealed this

Seventh Day of March, 1995

*Attest:*

Bruce Lehman

BRUCE LEHMAN

*Attesting Officer*

*Commissioner of Patents and Trademarks*